United States Patent [19]

Sasayama et al.

[11] 4,030,462

[45] June 21, 1977

[54] AIR-FUEL RATIO CONTROLLER FOR INTERNAL-COMBUSTION ENGINE

[75] Inventors: Takao Sasayama, Hitachi; Torazo Nishimiya, Mito, both of Japan

[73] Assignee: Hitachi, Ltd., Japan

[22] Filed: Mar. 5, 1976

[21] Appl. No.: 664,383

[30] Foreign Application Priority Data

Mar. 10, 1975 Japan ..... 50-28057

[52] U.S. Cl. ..... 123/119 EC; 123/32 EE; 60/285; 261/DIG. 74

[51] Int. Cl.[2] ..... F02N 3/00

[58] Field of Search ..... 123/32 EE, 119 EC; 60/285; 261/DIG. 74

[56] References Cited

UNITED STATES PATENTS

| | | | |
|---|---|---|---|
| 3,815,561 | 6/1974 | Seitz | 123/32 EE |
| 3,895,611 | 7/1975 | Endo et al. | 123/32 EE |
| 3,903,853 | 9/1975 | Kizler et al. | 60/285 |
| 3,938,075 | 2/1976 | Reddy | 60/285 |
| 3,984,976 | 10/1976 | Nagai | 60/285 |

*Primary Examiner*—C. J. Husar
*Assistant Examiner*—Paul Devinsky
*Attorney, Agent, or Firm*—Craig & Antonelli

[57] ABSTRACT

The output of an oxygen concentration detector monitoring the conditions of exhaust gases from an internal-combustion engine is not a linear function of the concentration but varies widely. When feeding this output back to control the air-fuel ratio of the mixture being fed to the engine, the feed back system having the small time constant (small delay time in operation) becomes unstable due to the nonlinear output of the oxygen concentration detector. In order to stabilize the operation of the system the output of the oxygen concentration detector is input to compensating circuit which outputs the voltage being proportioned to the oxygen concentration of the exhaust gas and the output is used as the feedback signal.

5 Claims, 9 Drawing Figures

AIR-FUEL RATIO CONTROLLER FOR INTERNAL-COMBUSTION ENGINE

FIELD OF THE INVENTION

This invention relates to an air-fuel ratio controller equipped with a feedback system which detects the concentration of oxygen in exhaust gases from an internal-combustion engine and controls the rate of fuel supply to the engine in response to the output of the detector as the feedback signal.

BACKGROUND OF THE INVENTION

It is well known that major contaminants in engine exhausts from gasoline-powered vehicles are carbon monoxide (CO), hydrocarbons (HC), and oxides of nitrogen (NOx), and that the rates of such emissions draw certain curves, following fixed patterns, with changes in the air-fuel ratio of the mixture being fed to the engine.

Also known is the fact that NOx are difficult to remove from the exhaust whereas the elimination of CO and HC is relatively easy. Removal of NOx is theoretically possible if the engine is operated with fuel supply controlled within the range of air-fuel ratio where the NOx discharge is at a minimum. However, many knotty problems must be solved before the method is carried into practice.

What is believed a promising approach in the art today is some system using a triple-action catalyst which can eliminate NOx, CO, and HC all at once. When such a catalyst is employed, however, the air-fuel ratio of the mixture being fed to the engine must be restricted in a narrow range close to the theoretical air-fuel ratio. In order to keep the air-fuel ratio within the limited range, a feedback control quick to act is a necessity, but the quick action tends to cause oscillation and seriously affect the stability of the feedback system.

It is therefore an object of this invention to provide an air-fuel ratio controller which can restrict the air-fuel ratio of fuel supply to an internal-combustion engine within a narrow range as desired.

Another object of the invention is to provide an air-fuel ratio controller for an internal-combustion engine, including a feedback system stable in performance.

Yet another object of the invention is to provide an air-fuel ratio controller for an internal-combustion engine, including a feedback system capable of accurately controlling a proportional-action, solenoid-operated valve.

In accordance with the present invention, there is provided an air-fuel ratio controller equipped with a feedback system which detects the conditions of exhaust gases from an internal-combustion engine and controls the air-fuel ratio in reponse to the detected values so that the ratio can be maintained within a desired range, characterized by a compensating circuit incorporated in the controller for correcting the output of the detector to be linear at all times relative to the air-fuel ratio of the gaseous mixture. The arrangement stabilizes the performance of the feedback system and increases the speed at which the system responds and works.

These and other objects, advantages, and features of the invention will become apparent from the following description of embodiments with reference to the accompanying drawings.

DETAILED DESCRIPTION OF THE PREFERRED EMBODIMENTS

Figure 1:
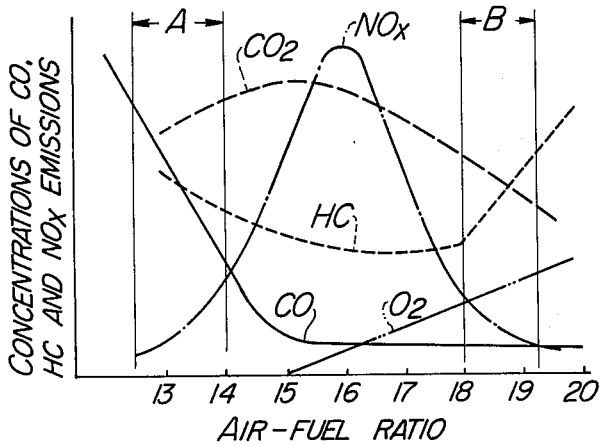
FIG. 1 is a graphic representation of the relations of the CO, HC, and NOx concentrations to the air-fuel ratio.

Generally, as FIG. 1 shows, the exhaust-gas contaminants CO, HC, and NOx from a motor vehicle are related in their concentrations to the air-fuel ratio of the mixture burned. Abatement of these emissions, therefore, usually employs control devices adapted for use in the rich and lean mixture zones A and B where the concentrations of NOx, the contaminants most difficult to convert into harmless substances, are at their lowest levels in the exhaust. However, the control means for the rich mixture zone works at the cost of increased fuel consumption and that for the lean zone involves reduction of the engine output and hence inferior engine performance and poor performability of the vehicle. Thus, much remains to be studied before a really practical way of solving or alleviating the problem is found out.

Figure 2:
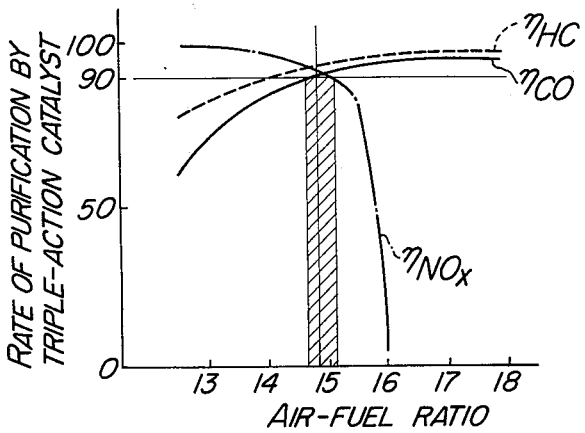
FIG. 2 is a graph showing the rates of purification attained by a triple-action catalyst.

Under the circumstances, there is a great need for a novel emission control system which can simultaneously eliminate all or most of the contaminants NOx, CO, and HC from the exhaust gases without unfavorably affecting the fuel economy, engine performance, and performability of the vehicle. Of the systems thus far proposed to meet this requirement, one which appears most promising uses a triple-action catalyst which both oxidizes CO and HC and reduces NOx to innocuous substances. The catalyst, as illustrated in FIG. 2, coverts more than 90% each of the three major pollutants to harmless gases when the engine runs with a mixture in the vicinity of its theoretical air-fuel ratio. It follows that the use of such a triple-action catalyst would provide a highly efficient emission control system.

Figure 3:
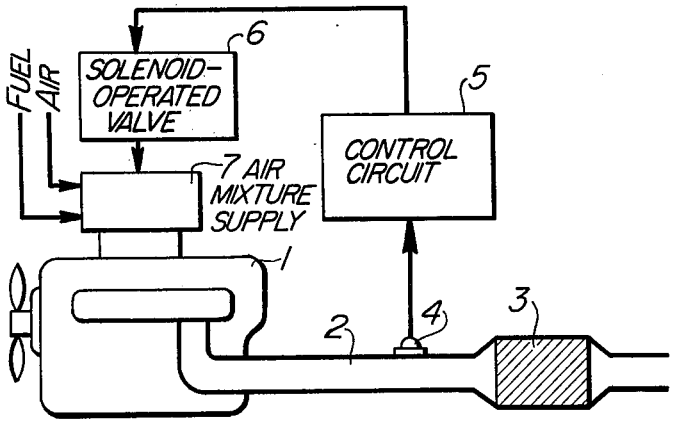
FIG. 3 is a block diagram of an emission control system equipped with a feedback control and to which the present invention is applicable.

As can be seen from FIG. 2, the rate of exhaust purification will be remarkably increased if the air-fuel ratio can be controlled within as narrow a range as feasible under all operating conditions of the engine. For example, if the variation of the air-fuel ratio is restricted within the zone defined by parallel broken lines in the figure, it will become possible to eliminate more than 90% of the harmful substances from the exhaust gases. A possible way of narrowing down the range of air-fuel ratio is feedback control, such as is typically incorporated in a system schematically shown in FIG. 3.

There is shown an internal-combustion engine 1 including an exhaust pipe 2 with a triple-action catalyst container 3 disposed midway. A detector 4 for detecting a certain constituent of the exhaust is installed upstream or in front of the catalyst container 3, so that its output is applied through a control circuit 5 to a proportional-action, solenoid-operated valve 6, where a proportional action caused by the stroke of the valve 6 related to the input from the detector is utilized to control the flow rate of fuel from an air-fuel mixture supply device 7, thus continuously varying and controlling the air-fuel ratio of the mixture.

The system of this character requires a detecctor for detecting the conditions of the exhaust gases and giving an output in response to which the solenoid-operated valve is to be controlled. If the detection characteristic of the detector is not constant but is distorted, the valve will no longer exactly respond to the conditions of the exhaust gases.

Among the exhaust-gas detectors so far proposed or under investigation is the oxygen concentration detector. The instrument usually exhibits a characteristic curve as typically given in FIG. 4. The feedback system that uses the detector naturally has similar characteristics. This means that, with the feedback system of the prior art, restricting the air-fuel ratio within a constant range would not be easy.

According to the present invention, compensation is made for nonlinear distortion of the output of such a detector, so that the detector output is almost in a linear relation to the variation in the air-fuel ratio of the mixture being fed to an engine, and the corrected output is input to the aforementioned control circuit 5.

The circuitry of a control circuit embodying the invention will now be described in connection with FIG. 7. The portion composed of an operational amplifier 8, a transistor 9, and a Zener diode 10 as the principal parts is a constant-voltage circuit 11 for obtaining the voltage $V_{cc}$ for actuating the operational amplifier, the voltage being 5 V. An IC 12 constitutes a buffer circuit 13 for matching the input and output impedances. Adjacent this circuit is located a compensating circuit 23 consisting of an operational amplifier 14, diodes 15, 16, resistors 17, 18, 19, 20, and potentiometers 21, 22. Another portion including an operational amplifier 24 and a transistor 25 as the major elements is a voltage control circuit 26 for automatically controlling the output voltage which, in turn, controls a load current $I_o$.

A power circuit 27, made up of a power transistor 28 and a load resistor 29, connects to a solenoid-operated valve 6.

The output $e_t$ of an exhaust-gas detector 4 is input to the control circuit of the contruction described through the buffer circuit 13 and is corrected by the compensating circuit 23. The output $e_o$ from the latter circuit is introduced into the voltage control circuit 26. This circuit coacts with the power circuit 27 to control the voltage so that the current $I_o$ of an intensity proportional to the output $e_o$ of the compensating circuit 23 can flow through the solenoid-operated valve 6.

Figure 4:
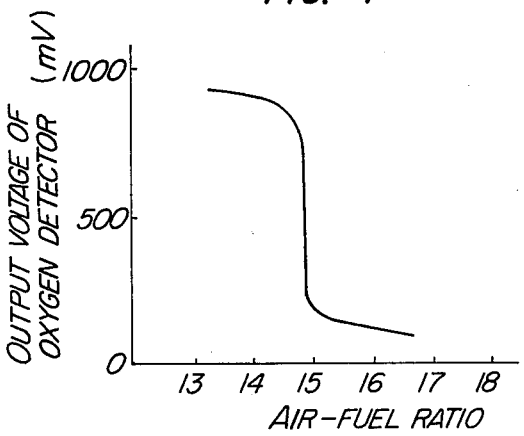
FIG. 4 is a graph showing the output characteristics of an oxygen-concentration detector.

If an oxygen concentration detector is employed as the exhaust-gas detector 4, the instrument will exhibit detection characteristics as graphically represented in FIG. 4. Where the oxygen concentration detector is used to make the actual air-fuel ratio to be known proportional to the output $e_o$ of the compensating circuit 23 (or to the current $I_o$ that flows through the solenoid-operated valve 6 because, in the embodiment being described, the output $e_o$ is proportional to the current $I_o$ too), the output $e_o$ of the compensating circuit 23, or the current $I_o$ through the solenoid-operated valve, has only to show the characteristics as represented in FIG. 5 with respect to the output of the oxygen concentration detector.

Figure 5:
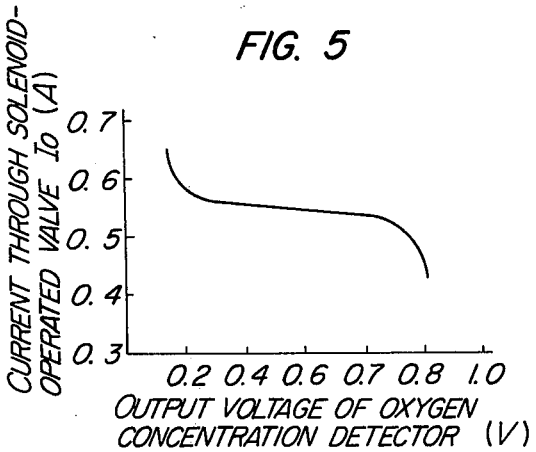
FIG. 5 is a graphic representation of the relation between the output voltage of an oxygen concentration detector and the current through a solenoid-operated valve.
Figure 6:
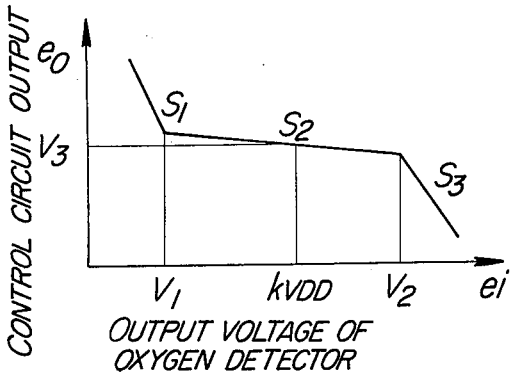
FIG. 6 is a graph showing the input-output characteristics of a control circuit according to the invention.
Figure 7:
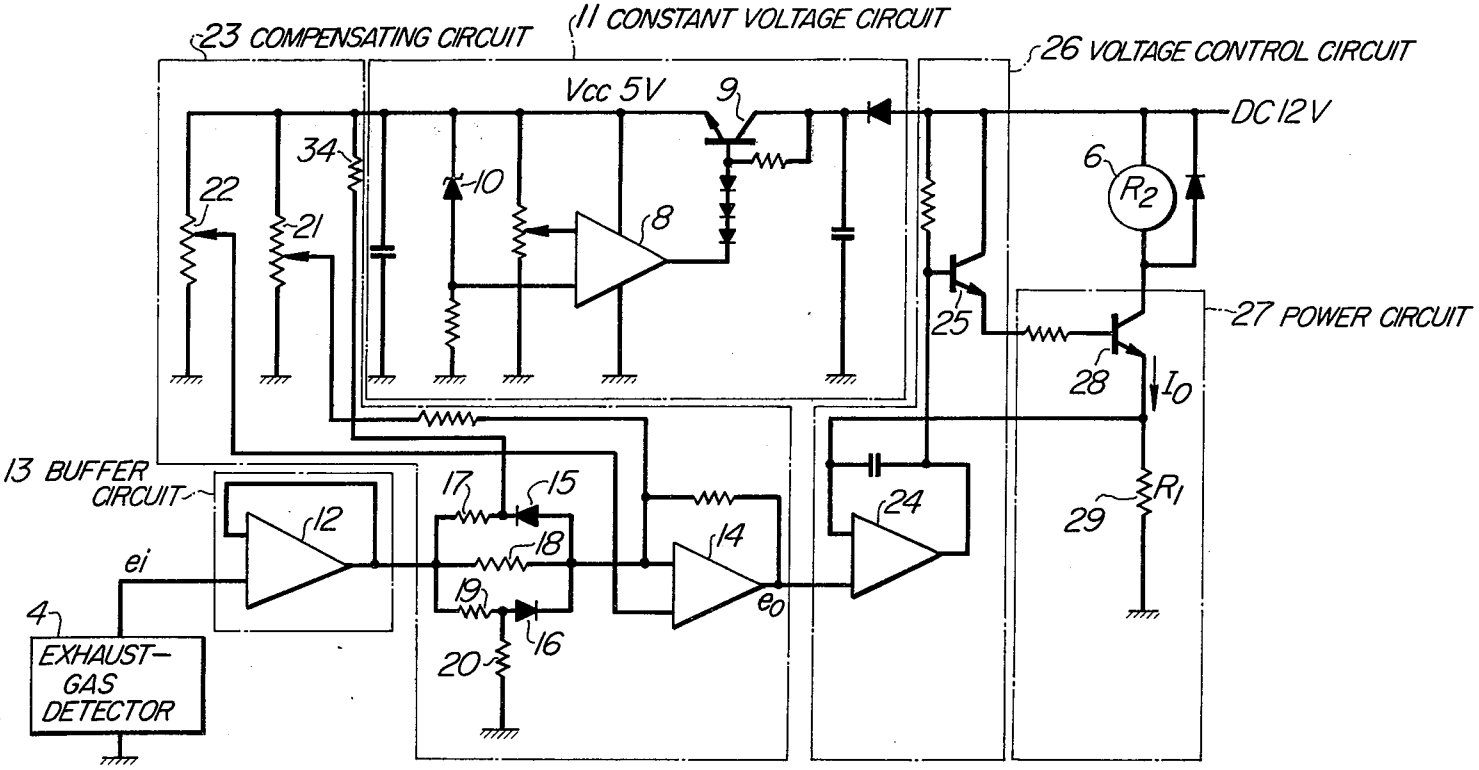
FIG. 7 is a diagram of a control circuit embodying the invention.

The compensating circuit 23 in FIG. 7 has output characteristics relative to the input as represented in FIG. 6, or close to the characteristic curve of FIG. 5. With this feature the circuit can correct the detection characteristics of the oxygen concentration detector.

Figure 8:
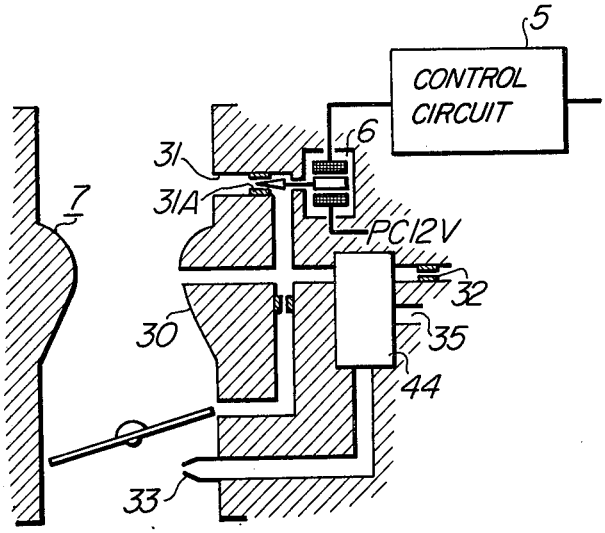
FIG. 8 is a schematic diagram illustrating a solenoid-operated valve associated with an air-fuel mixture supply device in one embodiment of the invention.

On the other hand, the proportional-action, solenoid-operated valve 6 is shown in FIG. 8 as an adjunct to an air-fuel mixture device 7. It is so disposed as to change continuously the cross sectional area of the feedback-control air bleed 31A in an air passage 31 which takes in air from the upstream of the venturi 30, and change the rate of fuel delivery relative to a given rate of air supply, thereby controlling the air-fuel mixture ratio. In the embodiment illustrated, the mixture supply device 7 is built, unlike an ordinary fixed-venturi carburetor, so that the negative pressure in the venturi and the differential between the pressures at the both ends of a main jet 32 enable a fuel controller 44 to meter the flow of fuel being supplied under a given pressure from a fuel supply port 35 and permit positive injection of the fuel from an injection nozzle 33. The proportional-action, solenoid-operated valve 6 works to have a negative pressure in the venturi controlled by the pressure in the air bleed, thus changing the fuel flow rate and controlling the air-fuel ratio.

The construction of the controller according to the present invention has so far been described. Now the control circuit having the characteristics shown in FIG. 6 will be explained with reference to FIGS. 6 and 7.

First, the characteristic $S_1$ is determined by the voltage $V_1$, and the voltage $V_1$ by the resistors 17, 34. The characteristic $S_3$ is determined by the voltage $V_2$, and the voltage $V_2$ by the resistors 19, 20. The characteristic $S_2$ is determined by the voltage $V_3$ and $kV_{DD}$ and the voltage $V_3$ is determined by the potentiometer 21 and the $kV_{DD}$ by the potentiometer 22.

Thus, the inclinations of the slopes $S_1$, $S_2$, $S_3$ depend on where the bend points $V_1$, $V_2$ are located.

Parallel shifting in the X-direction is effected by the potentiometer 22, and that in the Y-direction by the potentiometer 21.

These adjustments make it possible to obtain a solenoid-valve-driving current $I_o$ corresponding to the output $e_t$ of the oxygen-concentration detector 4 and control the air-fuel ratio according to the detector output.

Here it is important that the current $I_o$ is exactly proportional to the voltage $e_o$. To this end the circuitry of the invention is designed so that the voltage control circuit 26 measures the strength of the current $I_o$, changes the control current for the transistor 25 to establish a constant relationship between the voltage at the measured value of the current and the voltage $e_o$, and increases or decreases the base current for the power transistor 28, thereby controlling the current $I_o$ in such a manner that it automatically responds to the voltage $e_o$ and that the solenoid-operated valve functions accurately. In this way the performance characteristics of the valve is improved.

As described above, the embodiment of the invention is an emission control system using a detector for detecting the concentration of a constituent, e.g., oxygen, in exhaust gases and giving an output which changes stepwise in the vicinity of the theoretical air-fuel ratio, characterized in that a control current $I_o$ corresponding to the output is obtained and thereby the solenoid-operated valve is continuously controlled to maintain the air-fuel ratio in the carburetor proportional to the output of the concentration detector.

For this type of control, a system has already been proposed for on-off control of means for controlling the fuel feed according to the oxygen concentration in the mixture measured by a detector. However, because the control range must necessarily include a dead zone, the on-off control system is unable to control the air-fuel ratio with a high degree of precision.

The afore-described embodiment of the invention, by contrast, shows a distinct improvement in the accuracy of control since continuous control is possible over the entire range of air-fuel ratio. The circuitry is such that the input-output characteristics of the control circuit may be varied as desired by changing the circuit constant, and the functional pattern of the function-generating compensating circuit may be adjusted by changing the control resistance of the circuit to suit the performance of the oxygen-concentration detector. With the foregoing versatility, the controller according to the invention is freely adjustable to meet changes in characteristics by lots of manufacture as well as by changes in performance of the oxygen-concentration detector with time. Thus, it can adequately compensate for any dispersion in quality or deterioration in characteristics of such detectors.

Moreover, because of the added means for controlling the voltage to keep the current for driving the solenoid-operated valve suited at all times to the input, the accuracy of control between the input and output, or the final control accuracy of the control circuit as a whole, is markedly improved over the existing systems of this character, and thus the most important problem of those systems is solved in a very advantageous way.

Further practical advantages include the extremely simple circuit construction and availability at low cost.

The compensating circuit 23 has been illustrated merely by way of exemplification, and its output is determined by the characteristics of the exhaust-gas detector. If the characteristics are as graphically represented in FIG. 4, it will be possible, as is apparent from the illustration of the embodiment in FIG. 7, to produce an output in a pattern similar to that of the characteristics shown in FIG. 4 and construct the circuit so that the pattern is reversed as in FIG. 5. In this manner the detector characteristics can be corrected.

In addition, the circuit diagram of FIG. 7 includes the buffer circuit 13 which raises the input impedance. The circuit permits the output detected by the detector to be input to the controller with fidelity. It also makes possible the determination of the resistance of the compensating circuit without the need of taking the impedance of the detector 4 into consideration.

FIG. 8 illustrates another form of the circuit according to the invention for controlling the air-fuel ratio by allowing the control current $I_o$ to actuate the solenoid-operated valve 6 in the manner described. Shown in the figure is an injection type carburetor which detects the negative pressure in the venturi, meters the fuel delivery on the basis of the negative pressure in the venturi and the differential between the pressures at the both ends of the main jet 32, and injects the fuel positively at a point downstream of the throttle valve, characterized in that an air bleed is provided to control the negative pressure in the venturi so that by changingthe cross sectional area of the air bleed the fuel flow rate can be changed to maintain a constant air-fuel ratio to meet varying engine requirements despite the unchanged rate of air supply.

The fuel feed may be controlled in still another way. For example, in a carburetor of the type which meters fuel by dint of the differential between the pressures at the both ends of the main jet and draw in the metered fuel from the venturi under negative pressure through an emulsion pipe, the air inlet portion of the emulsion pipe may be formed with an orifice whose cross sectional area is changeable to vary the fuel flow rate so as to attain the constancy of air-fuel ratio.

Figure 9:
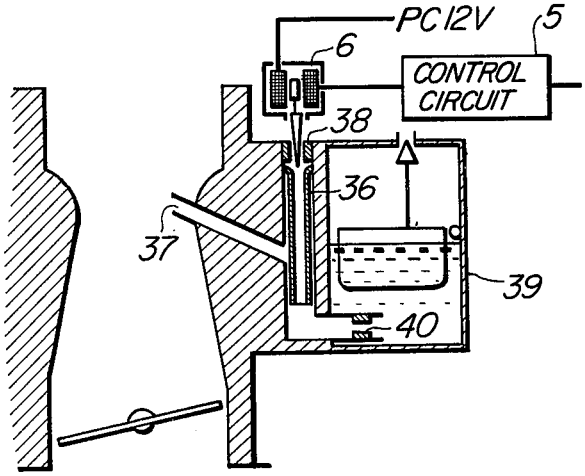
FIG. 9 is a schematic diagram illustrating a solenoid-operated valve associated with an air-fuel mixture supply device in another embodiment of the invention.

FIG. 9 shows a venturi type carburetor as an air-fuel mixture supply system incorporating the present invention. The fuel from the float chamber 39 is metered by the main jet 40 and is mixed with air by the emulsion pipe 36, and the mixture is injected through the main nozzle 37.

It follows that the fuel flow rate can be varied with respect to the same rate of air flow by changing the amount of air supply to the emulsion pipe 36, or by changing the cross sectional area of the orifice (air bleed) 38 provided above the emulsion pipe.

The present invention provides the means of changing the cross sectional area of the orifice 38, in the form of the solenoid-operated valve 6 as shown in FIG. 9 for proportional action corresponding to the output of the oxygen detector 4.

As a further alternative, it is, of course, possible to change the cross sectional area of the main jet 40 instead of the orifice for fuel metering, so as to control the fuel supply and change the air-fuel ratio.

With the embodiments of FIGS. 8 and 9, as above described, it is possible to control the air-fuel ratio by combining an ordinary carburetor with a solenoid-operated valve, and achieve a much higher accuracy of air-fuel ratio control than with conventional fuel supply systems. Consequently, the variation in the air-fuel ratio can be maintained in a very narrow range.

As has been described above, the air-fuel ratio can be controlled within a very narrow range constant despite varying operating conditions, in accordance with the present invention. This permits an efficient use of a triple-action catalyst and therefore simultaneous control of CO, HC, NOx. Further, because the air-fuel ratio is controlled within a constant ratio, increased fuel economy and stability of power output and hence improved engine performance can be expected.

What is claimed is:

1. An air-fuel ratio controller for an internal-combustion engine comprising air-fuel mixture supply means for changing the air-fuel ratio of the mixture being fed to the engine in response to an input signal, means for conducting the air-fuel mixture from the supply means to the engine cylinders, catalyst means for removing harmful constituents from the exhaust gases, an exhaust pipe for conducting the exhaust gases from the engine to the catalyst means, a detector installed on the exhaust pipe to detect the conditions of the exhaust gases, said detector having output characteristics such that, centering around a first range of actual air-fuel ratio of the mixture being fed to the engine, there are a first region where the output sharply varies away from either side of the first range and a second region where the variation in output is moderate a certain value away from the first range, means for outputting a first signal inversely proportional to the rate of output variation relative to the first region of air-fuel ratio in the output characteristics of the detector, means for outputting a second signal inversely proportional to the rate of output variation relative to the second regions of air-fuel ratio in the output characteristics of the detector, said first and second signal outputting means both serving as means for compensating the output of the detector, first connector means for connecting the output of the detector with the inputs of the first and second signal outputting means which serve the compensating means, and second connector means for applying the output of the compensating means to the input of the air-fuel mixture supply means.

2. An air-fuel ratio controller according to claim 1 wherein the detector is an oxygen-concentration detector.

3. An air-fuel ratio controller according to claim 2 wherein the air-fuel mixture supply means comprises a throttle valve for controlling the amount of fuel to be supplied and a solenoid coil for continuously changing the opening angle of the throttle valve correspondingly to the amount of input current, the output of the compensating means being applied to the solenoid coil by the second connector means.

4. An air-fuel ratio controller according to claim 3 wherein the second connector means comprises current control means, means for detecting the current flowing through the solenoid coil, and means for serially connecting the current control means and the current detecting means to the solenoid coil, said current control means being capable of controlling the current to a solenoid coil in such a manner that the output of the current detecting means becomes equal to the output of the compensating means.

5. An air-fuel ratio controller according to claim 4 wherein the second connector means includes an operational amplifier to which the outputs of the current detecting means and compensating means are input and the difference is found thereby, and the output of the operational amplifier is input of the current control means.

* * * * *